US006379258B1

(12) United States Patent
To

(10) Patent No.: US 6,379,258 B1
(45) Date of Patent: Apr. 30, 2002

(54) METHOD OF ALIGNING A GOLF BALL WITH A GOLF CLUB AND GOLF CLUB WITH ALIGNMENT INDICIA

(76) Inventor: Siu To, 11225 - 91 Street, Edmonton, Alberta (CA), T5S 4A1

( * ) Notice: Subject to any disclaimer, the term of this patent is extended or adjusted under 35 U.S.C. 154(b) by 0 days.

(21) Appl. No.: 09/470,899

(22) Filed: Dec. 23, 1999

(30) Foreign Application Priority Data

May 5, 1999 (CA) ..... 2257728

(51) Int. Cl.[7] ..... A63B 69/36
(52) U.S. Cl. ..... 473/242; 473/251; 473/409
(58) Field of Search ..... 473/257, 238, 473/242, 219, 226, 231, 268, 409, 330, 131, 251, 252, 255, 324; D21/736, 743, 744

(56) References Cited

U.S. PATENT DOCUMENTS

| | | | | |
|---|---|---|---|---|
| 58,209 | A | * | 6/1866 | Bacheller |
| 1,485,272 | A | * | 2/1924 | Kinsman |
| 2,395,837 | A | * | 3/1946 | Baymiller |
| 2,842,369 | A | * | 7/1958 | East |
| 2,859,972 | A | * | 11/1958 | Reach |
| 2,934,347 | A | * | 4/1960 | Siniscalchi |
| 3,199,873 | A | * | 8/1965 | Surratt |
| 3,680,860 | A | * | 8/1972 | Elkins |
| 3,876,211 | A | | 4/1975 | Caligiuri |
| 3,880,430 | A | | 4/1975 | McCabe |
| 4,128,244 | A | | 12/1978 | Duclos |
| 4,157,830 | A | * | 6/1979 | Taylor |
| 4,174,839 | A | * | 11/1979 | Marrs |
| 4,209,172 | A | | 6/1980 | Yamamoto |
| 4,550,914 | A | | 11/1985 | McCallister |
| 4,659,083 | A | * | 4/1987 | Szczepanski |
| 4,819,943 | A | * | 4/1989 | Szczepanski |
| 5,509,657 | A | | 4/1996 | Guthy |
| 5,558,332 | A | | 9/1996 | Cook |
| 5,720,668 | A | | 2/1998 | Brett |
| 6,059,669 | A | * | 5/2000 | Pearce |
| 6,244,974 | B1 | * | 6/2001 | Hanberry |

OTHER PUBLICATIONS

Maximum projectile range with drag and lift, with particular application to golf, Herman Erlichson, Reprinted from American Journal of Physics 51, 357–362 (1983); The Physics of Sports, p. 71–76.

The Physics of a Curveball by Professor Peter J. Brancazio, Popular Mechanics, Apr. 1997, p. 56–57.

* cited by examiner

*Primary Examiner*—Sebastiano Passaniti
(74) *Attorney, Agent, or Firm*—Christensen O'Connor Johnson Kindness PLLC

(57) ABSTRACT

A golf club with alignment indicia and method of use of the same. The golf club includes a shaft having a gripping end and a remote end. A club head is secured to the remote end of the shaft. The club head has a top and a striking face. The alignment indicia are in the form of a first straight line and a second straight line positioned in spaced apart relation on the top of the club head. The first straight line and the second straight line diverge as they approach the striking face. The first straight line is closer to the shaft than the second straight line. By selecting the first straight line or the second straight line for alignment, the striking face of the golf club is moved to an open or closed position to aid in intentional placement of the golf ball from the left or right toward a selected target.

2 Claims, 2 Drawing Sheets

METHOD OF ALIGNING A GOLF BALL WITH A GOLF CLUB AND GOLF CLUB WITH ALIGNMENT INDICIA

FIELD OF THE INVENTION

The present invention relates to a method of aligning a golf ball with a golf club and a golf club with alignment indicia

BACKGROUND OF THE INVENTION

In order for a golfer to improve his or her score, the golfer must be able to exercise control over the placement of the ball in relation to a target. There are various methods of alignment and golf clubs with indicia for alignment for making straight shots, but very little to aid a golfer in intentionally placing a shot from the left or from the right to a target.

SUMMARY OF THE INVENTION

What is required is a method of alignment and a golf club with indicia for alignment that will aid a golfer in ball placement in relation to a target.

According to one aspect of the present invention there is provided a golf club which includes a shaft having a gripping end and a remote end. A club head is secured to the remote end of the shaft. The club head has a top and a striking face. Alignment indicia are provided in the form of a first straight line and a second straight line positioned in spaced apart relation on the top of the club head. The first straight line and the second straight line diverge as they approach the striking face. The first straight line is closer to the shaft than the second straight line.

According to another aspect of the invention there is provided a method of aligning a golf ball with a golf club. A golf club with alignment indicia is provided substantially as described above. In order to strike a golf ball from a first side of a target toward the target, a circumferential edge of the golf ball is positioned against the striking face of the club head in alignment with the first straight line. In order to strike a golf ball from a second side of a target toward the target a circumferential edge of the golf ball is positioned against the striking face of the club head in alignment with the second straight line.

A controlled angular impact with the ball so as to place a shot from a position to the left side or right side of a target toward the target, is a subtle movement. If the golfer overadjusts he or she will end up hooking or slicing the golf ball out of bounds. Even more beneficial results may, therefore, be obtained when the first straight line and the second straight line diverge at an angle of between 2 and 5 degrees.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
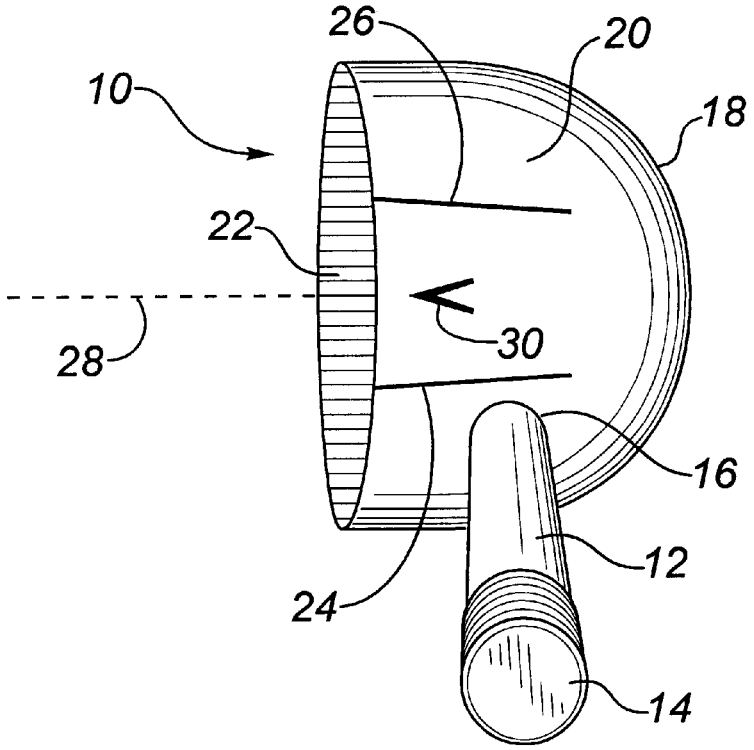
FIG. 1 is a top plan view of a golf club having alignment indicia in accordance with the teachings of the present invention.

The preferred embodiment, a golf club generally identified by reference numeral 10, will now be described with reference to FIGS. 1 through 3.

Referring to FIG. 1, golf club 10 comprises a shaft 12 having a gripping end 14 and a remote end 16, and a club head 18 secured to remote end 16 of shaft 12. Club head 18 has a top 20 and a striking face 22. Alignment indicia in the form of a first straight line 24 and a second straight line 26 are positioned in spaced apart relation on the top 20 of club head 18. First straight line 24 is closer to shaft 12 than is second straight line 26. First straight line 24 and second straight line 26 diverge as they approach striking face 22. First straight line 24 diverges from a perpendicular to striking face 22, shown as a dotted line 28, at an angle of between 2 and 5 degrees in a first direction away from shaft 12. Second straight line 26 diverges from the perpendicular 28 to striking face 22 at an angle of between 2 and 5 degrees, in a second direction toward shaft 12. An alignment indicia 30 in the form of an arrowhead is positioned intermediate first straight line 24 and second straight line 26.

Figure 2:
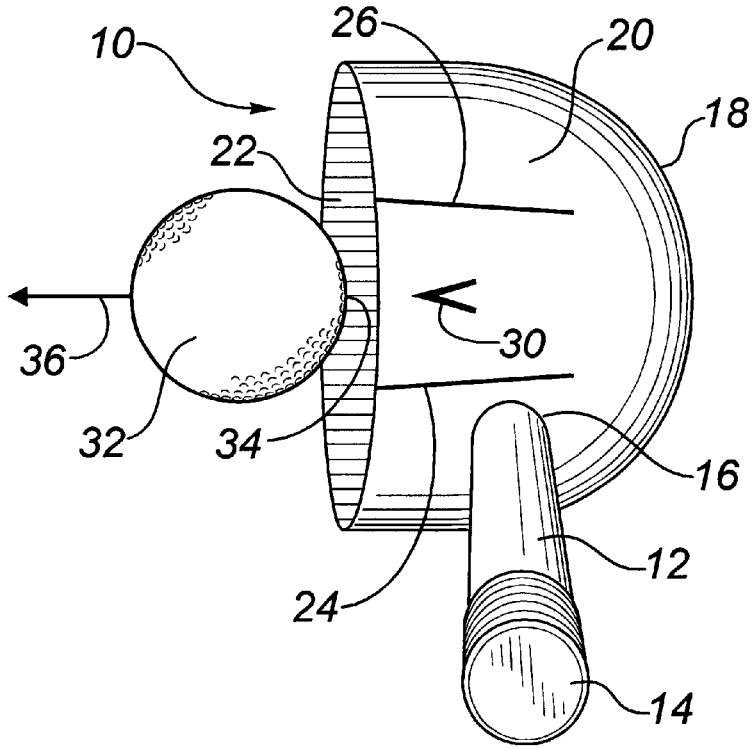
FIG. 2 is a top plan view of the golf club illustrated in FIG. 1, with a golf ball aligned so as to perform an intentional placement from a first side of a target, toward the target.

Referring to FIGS. 2, a method of aligning a golf ball 30 with a golf club 10 to attempt to hit a straight shot comprises the steps of providing a golf club 10 as described above, and aligning a golf ball 32 with club 10 as will now be described. Golf ball 32 is placed against striking face 22 of club head 18 with the center of golf ball 32 in alignment with arrowhead alignment indica 30. Club 10 is then swung so as to strike ball 32 in line with alignment indicia 30 with the objective of causing ball 32 to travel in a first direction, shown by arrow 36, perpendicular to striking face 22. This alignment can be used with all manner of clubs including putters, irons and woods. With irons and woods, the ball is imparted with a slight back spin caused by the angle of inclination of the club face.

Figure 3:
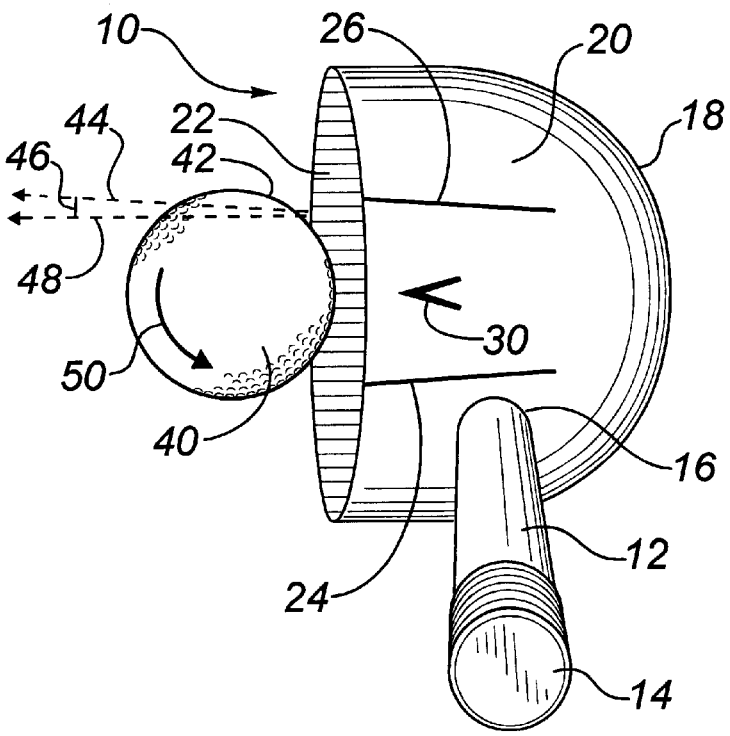
FIG. 3 is a top plan view of the golf club illustrated in FIG. 1, with a golf ball aligned so as to perform an intentional placement from a second side of a target, toward the target.

Referring to FIG. 3, a method of aligning a golf ball 40 with golf club 10 in a closed face position in order to place the golf ball from a second side of a target toward the target. With a putter, the target is the golf hole. With an approach shot the target is the flag marking the golf hole. With a wood, the target may be an identifiable landmark that can be seen in the distance on the fairway. The method includes the steps of providing golf club 10 as described above, and aligning golf ball 40 with golf club 10 as will now be described. A circumferential edge 42 of golf ball 40 is placed against club head 18 in alignment with second straight line 26. Golf club 10 is then swung along a second direction, shown by a dotted arrow 44, at an angle 46 to the perpendicular to striking face 22, shown by dotted arrow 48, so as to strike golf ball 40 in line with second straight line 26. Golf ball 40, having been struck in this manner, initially travels in the second direction shown by arrow 44 and spins in a third or counterclockwise direction shown by curved arrow 50. The spin imparted to golf ball 40 causes golf ball 40 to progressively deviate toward the target. This deviation may be a matter of necessity when the fairway doglegs or it may be a matter of strategy in order to place the ball on a fairway to the left or right of a hazard. When putting the deviation is always intended to improve ball placement by accentuating a pre-existing topographical feature of the green. Of course, with irons and woods the ball is also imparted with a slight back spin caused by the angle of inclination of the club face.

Figure 4:
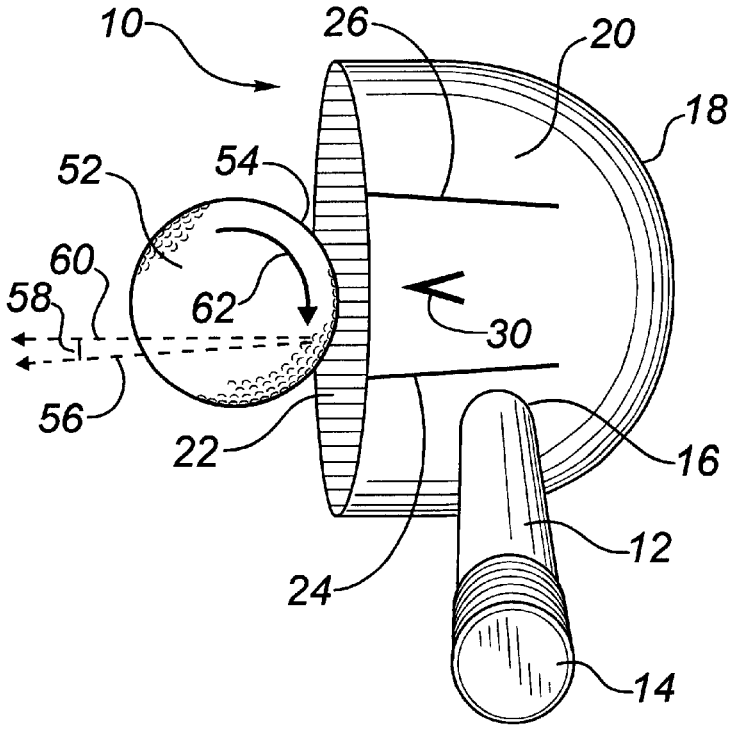
FIG. 4 is a top plan view of the golf club illustrated in FIG. 1, with a golf ball aligned so as to perform an intentional placement from a first side of a target, toward the target.

Referring to FIG. 4, a method of aligning a golf ball 52 with golf club 10 in an open face position in order to place the golf ball from a first side of a target toward the target. As previously described, with a putter, the target is the golf hole. With an approach shot the target is the flag marking the golf hole, with a wood, the target may be an identifiable landmark that can be seen in the distance on the fairway. The method includes the steps of providing golf club 10 as described above, and aligning golf ball 52 with golf club 10 as will now be described. A circumferential edge 54 of golf ball 52 is placed against striking face 22 of club head 18 in alignment with first straight line 24. Golf club 10 is then swung along a fourth direction, shown by a dotted arrow 56, at an angle 58 to the perpendicular to striking face 22, shown by dotted arrow 60, so as to strike golf ball 52 in line with first straight line 24. Golf ball 52, having been struck in this manner, initially travels in the fourth direction shown by arrow 56 and spins in a fifth or clockwise direction shown by curved arrow 62. The spin imparted to golf ball 52 causes golf ball 52 to progressively deviate toward the target. As previously described, this deviation may be a matter of necessity when the fairway doglegs or it may be a matter of strategy in order to place the ball on a fairway to the left or right of a hazard. When putting the deviation is always intended to improve ball placement by accentuating a pre-existing topographical feature of the green. Of course, with irons and woods the ball is also imparted with a slight back spin caused by the angle of inclination of the club face.

It will be apparent to one skilled in the art that modifications may be made to the illustrated embodiment without departing from the spirit and scope of the invention as hereinafter defined in the claims.

What is claimed is:

1. A golf club, comprising:

a shaft having a gripping end and a remote end;

a club head secured to the remote end of the shaft, the club head having a top and a striking face; and alignment indicia in the form of a first straight line and a second straight line positioned in spaced apart relation on the top of the club head with the first straight line and the second straight line diverging as they approach the striking face by between 2 and 5 degrees relative to perpendicular to the striking face, the first straight line being closer to the shaft than the second straight line, the first straight line and the second straight line being spaced more than a golf ball's width apart.

2. A method of aligning a golf ball with a golf club, comprising the steps of:

providing a golf club having a shaft with a gripping end and a remote end;

a club head secured to the remote end of the shaft, the club head having a top and a striking face; and alignment indicia in the form of a first straight line and a second straight line positioned in spaced apart relation on the top of the club head with the first straight line and the second straight line diverging as they approach the striking face by between 2 and 5 degrees relative to perpendicular to the striking face, the first straight line being closer to the shaft than the second straight line, the first straight line and the second straight line being spaced more than a golf ball's width apart; and positioning a circumferential edge of a golf ball against the striking face of the club head in alignment with one of the first straight line and the second straight line, the circumferential edge of the golf ball being placed in alignment with the first straight line in order to open the striking face to place the golf ball in a first direction and the circumferential edge of the golf ball being placed in alignment with the second straight line in order to close the club face to place the golf ball in a second direction.

* * * * *

UNITED STATES PATENT AND TRADEMARK OFFICE

CERTIFICATE OF CORRECTION

PATENT NO. : 6,379,258 B1
DATED : April 30, 2002
INVENTOR(S) : S. To

It is certified that error appears in the above-identified patent and that said Letters Patent is hereby corrected as shown below:

Title page, Item [54] and Column 1, lines 1-3,
Title, "METHOD OF ALIGNING A GOLF BALL WITH A GOLF CLUB AND GOLF CLUB WITH ALIGNMENT INDICIA" should read -- METHOD OF ALIGNING A GOLF BALL WITH A GOLF CLUB AND A GOLF CLUB WITH ALIGNMENT INDICIA --

Item [30], Foreign Application Priority Data, "May 5, 1999" should read -- January 5, 1999 --

Item [56], References Cited, U.S. PATENT DOCUMENTS, "58,209 A * 6/1866 Bacheller" should read --D58,209 S * 6/1921 Bacheller --

Signed and Sealed this

Twenty-sixth Day of November, 2002

*Attest:*

*Attesting Officer*

JAMES E. ROGAN
*Director of the United States Patent and Trademark Office*